US007155920B2

(12) United States Patent
Lifson et al.

(10) Patent No.: US 7,155,920 B2
(45) Date of Patent: Jan. 2, 2007

(54) REFRIGERANT CYCLE WITH TANDEM COMPRESSORS AND MULTIPLE CONDENSERS

(75) Inventors: Alexander Lifson, Manlius, NY (US); Michael F. Taras, Fayetteville, NY (US)

(73) Assignee: Carrier Corporation, Syracuse, NY (US)

( * ) Notice: Subject to any disclaimer, the term of this patent is extended or adjusted under 35 U.S.C. 154(b) by 171 days.

(21) Appl. No.: 10/967,862

(22) Filed: Oct. 18, 2004

(65) Prior Publication Data

US 2006/0080984 A1 Apr. 20, 2006

(51) Int. Cl.

| | |
|---|---|
| ***F25B 7/00*** | (2006.01) |
| ***F25B 41/00*** | (2006.01) |
| ***F25B 49/00*** | (2006.01) |
| ***F25B 1/10*** | (2006.01) |

(52) U.S. Cl. ..... 62/175; 62/196.2; 62/196.4; 62/510

(58) Field of Classification Search ..... 62/175, 62/196.2, 196.3, 196.4, 510

See application file for complete search history.

(56) References Cited

U.S. PATENT DOCUMENTS

| | | | | |
|---|---|---|---|---|
| 3,589,141 | A * | 6/1971 | Caswell | 62/448 |
| 5,875,637 | A * | 3/1999 | Paetow | 62/117 |
| 6,018,957 | A * | 2/2000 | Katra et al. | 62/175 |
| 6,065,304 | A * | 5/2000 | Koo | 62/475 |
| 6,679,072 | B1 * | 1/2004 | Pham et al. | 62/126 |

* cited by examiner

*Primary Examiner*—Marc Norman
(74) *Attorney, Agent, or Firm*—Carlson, Gaskey, Olds

(57) ABSTRACT

A tandem compressor system is utilized that receives refrigerant from a common suction manifold, and from a common evaporator. From the compressors, the refrigerant passes to a plurality of condensers, with each of the condensers being associated with a separate zone for heat rejection, preferably at different temperature levels. Each of the condensers is associated with at least one of the plurality of compressors. By utilizing the common evaporator, yet a plurality of condensers, the ability to independently control temperature and amount of heat rejection to a number of zones is achieved without the requirement of having a dedicated circuit with multiple additional components. Thus, the overall system cost and complexity can be greatly reduced. In embodiments, one or more of the plurality of compressors can be provided by a compressor bank, having its own plurality of compressors.

17 Claims, 1 Drawing Sheet

REFRIGERANT CYCLE WITH TANDEM COMPRESSORS AND MULTIPLE CONDENSERS

BACKGROUND OF THE INVENTION

This application relates to a refrigerant cycle utilizing tandem compressors sharing a common evaporator, but having separate condensers.

Refrigerant cycles are utilized in applications to change the temperature and humidity or otherwise condition the environment. In a standard refrigerant system, a compressor delivers a compressed refrigerant to a heat exchanger, known as a condenser, which is typically located outside. From the condenser, the refrigerant passes through an expansion device, and then to an indoor heat exchanger, known as an evaporator. At the evaporator, moisture may be removed from the air, and the temperature of air blown over the evaporator coil is lowered. From the evaporator, the refrigerant returns to the compressor. Of course, basic refrigerant cycles are utilized in combination with many configuration variations and optional features. However, the above provides a brief understanding of the fundamental concept.

In more advanced refrigerant systems, a capacity of the air conditioning system can be controlled by the implementation of so-called tandem compressors. The tandem compressors are normally connected together via common suction and common discharge manifolds. From a single common evaporator, the refrigerant is returned through a suction manifold, and then distributed to each of the tandem compressors. From the individual compressors the refrigerant is delivered into a common discharge manifold and then into a common single condenser. The tandem compressors are also separately controlled and can be started and shut off independently of each other such that one or both compressors may be operated at a time. By controlling which compressor is running, control over the capacity of the combined system is achieved. Often, the two compressors are selected to have different sizes, such that even better capacity control is provided. Also, tandem compressors may have shutoff valves to isolate some of the compressors from the active refrigerant circuit, when they are shutdown. Moreover, if these compressors operate at different saturation suction temperatures, pressure equalization and oil equalization lines are frequently employed.

One advantage of the tandem compressor is that better capacity control is provided, without the requirement of having each of the compressors operating on a dedicated circuit. This reduces the system cost.

Tandem compressors provide untapped potential for even greater control. The tandem compressors have not been provided in many beneficial combinations that would be valuable.

SUMMARY OF THE INVENTION

In this invention, as opposed to the conventional tandem system, there is no discharge manifold connecting the tandem compressors together. Each of the tandem compressors is connected to its own condenser, while both compressors are still connected to a common suction manifold and a single evaporator. Consequently, for such tandem compressor system configurations, additional temperature levels of heat rejection, associated with each condenser, become available. An amount of refrigerant flowing through each condenser can be regulated by flow control devices placed at the compressor discharge ports as well as by controlling related expansion devices or utilizing other control means, such as condenser airflow.

The present invention, by providing separate condensers, allows for heat rejection at two different temperatures and to two different zones. As an example, a first condenser could be associated with an outdoor zone, while the second condenser is associated with an indoor zone that would be at a different temperature. By controlling the temperature at which heat is rejected, the amount of the refrigerant passing from that condenser can be tightly controlled. One possible application would be to utilize one of the condensers to prevent excessive frost formation (defrost operation), with the other condenser being operable in a conventional manner as in normal air conditioning installations. Many other applications such as air stream reheat in dehumidification applications or space heating are also feasible.

It should be understood that if more than two tandem compressors are connected together, then the system can operate at each additional temperature level associated with the added compressor. For example, with three compressors, heat rejection at three temperature levels can be achieved by connecting each of the three compressors to a dedicated condenser. In another arrangement two out of the three compressors can operate with common suction and discharge manifold and be connected to the same condenser, while the third compressor can be connected to a separate condenser. Of course, the tandem application can be extended in analogous manner to more than three compressors.

These and other features of the present invention can be best understood from the following specification and drawings, the following of which is a brief description.

DETAILED DESCRIPTION OF THE PREFERRED EMBODIMENT

Figure 1:
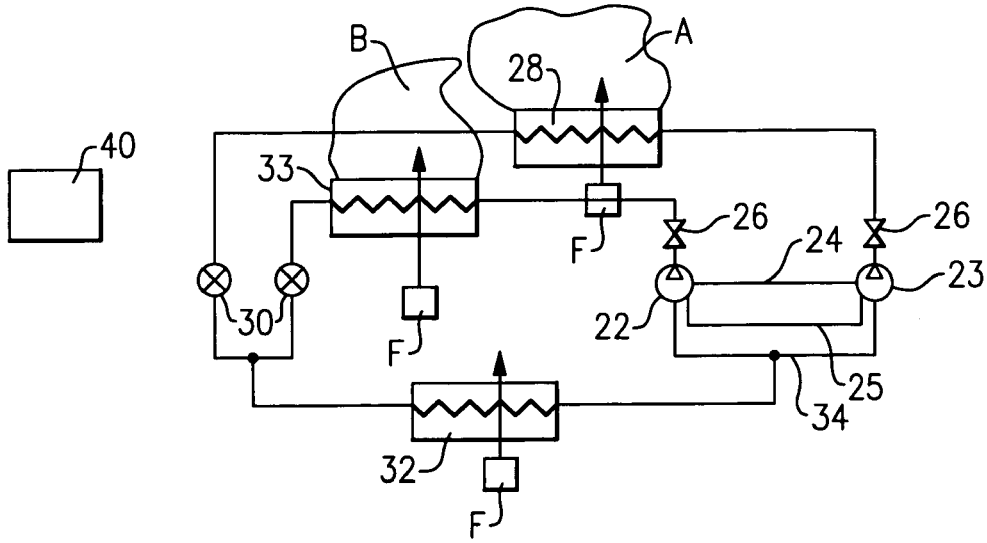
FIG. 1 is a first schematic.

A refrigerant cycle 20 is illustrated in FIG. 1 having a pair of compressors 22 and 23 that are operating generally as tandem compressors. A pressure equalization line 24 and an oil equalization line 25 may connect the two compressors 22 and 23, as known. Optional valves 26 are positioned downstream on a discharge line associated with each of the compressors 22 and 23. These valves can be controlled to prevent backflow of refrigerant to either of the compressors 22 or 23 should only one of the compressors be operational. That is, if for instance the compressor 22 is operational with the compressor 23 stopped, then the valve 26 associated with the compressor 23 will be closed.

Refrigerant from the compressor 23 travels to a condenser 28. The refrigerant continues downstream and through an expansion device 30. From the expansion device 30, the flow passes through an evaporator 32. The refrigerant passing through the evaporator 32 passes to a suction manifold 34 leading back to the compressors 22 and 23. The refrigerant from the compressor 22 passes through a condenser 33. The refrigerant also passes through an expansion device 30 and then returned through the evaporator 32 and suction manifold 34 back to the compressors 22 and 23. Separate fans F are shown moving air over condensers 28 and 33.

The present invention, by providing separate condensers, allows heat rejection at two different temperature levels and to two different zones A and B. As an example, a first condenser could be associated with an outdoor zone A, while the second condenser is associated with the indoor zone B that would be at a different temperature. By controlling the temperature at which heat is rejected, the amount of the refrigerant passing from that condenser can be tightly controlled. One possible application would be to utilize one of the condensers to prevent excessive frost formation (defrost operation), with the other condenser being operable in a conventional manner as in normal air conditioning installations. Many other applications such as air stream reheat in dehumidification applications or space heating are also feasible.

A control 40 for the refrigerant cycle 20 is operably connected to control the compressors 22 and 23, the expansion devices 30, and the valves 26. By properly controlling each of these elements in combination, the conditions at each condenser 28 and 33 can be controlled as necessary for the sub-environments A and B. The exact controls necessary are as known in the art, and will not be explained here. However, the use of the tandem compressors 22 and 23 utilizing a common evaporator 32 reduces the number of components necessary for providing the independent control for the heat rejection to areas A and B, and thus is an improvement over the prior art.

Also, it has to be understood that the valves 26 can be of a conventional on/off or adjustable type, with the valve control executed through pulsation or modulation. In such cases even more flexibility in control can be achieved.

Figure 2:
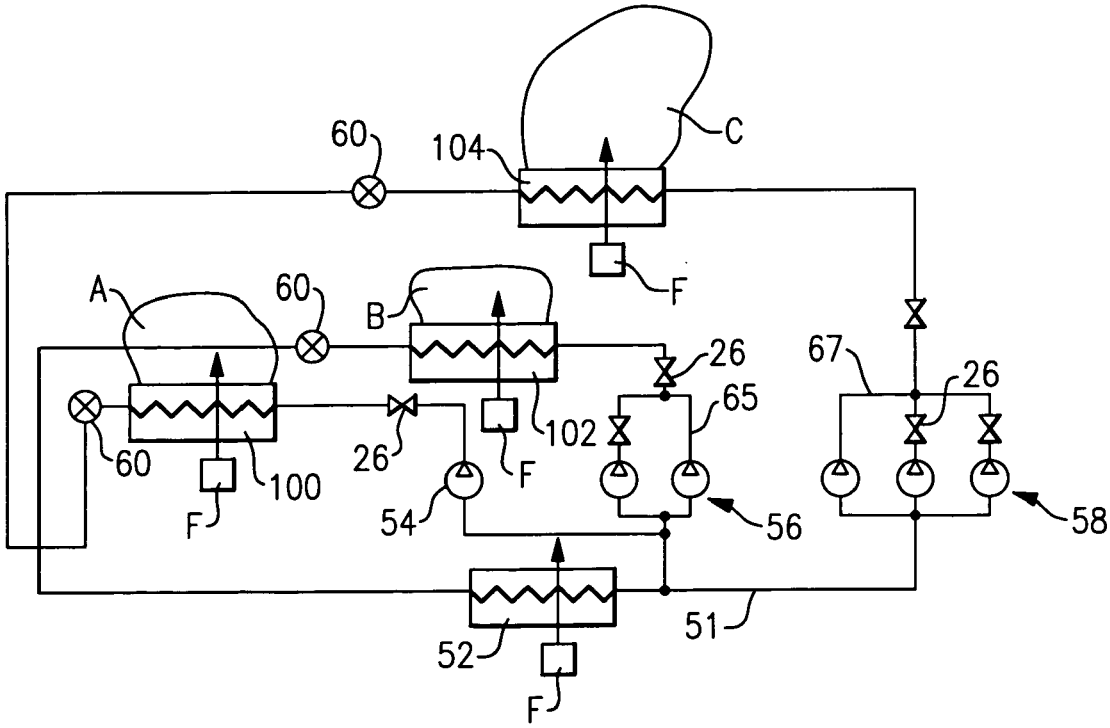
FIG. 2 is a second schematic.

FIG. 2 shows a more complicated refrigerant cycle 50 for rejecting heat to three zones A, B and C. As shown, a single evaporator 52 communicates with a suction manifold 51. A first compressor 54 also communicates with the suction manifold 51. A second compressor bank 56 includes two tandem compressors which each communicating with a discharge manifold 65 and suction manifold 51.

A third compressor bank 58 includes three compressors all operating in tandem and communicating with a discharge manifold 67 and, once again, with suction manifold 51. The control of the compressor banks 56 and 58 may be as known in the art of tandem compressors. As mentioned above, by utilizing the compressor banks 56 and 58, a control over the temperature level and an amount of heat rejection in each of the zones B and C is provided.

From the condensers 100, 102 and 104, the refrigerant passes through separate expansion devices 60, and to evaporator 52. As is shown, condenser 102 rejects heat to zone B, and condenser 104 rejects heat to zone C. Again, a control 72 is provided that controls each of the elements to achieve the desired conditions within each of the condensers 100, 102 and 104. The individual control steps taken for each of the condensers would be known. It is the provision of the combined system utilizing a common evaporator in combination with the tandem compressors and separate condensers that is inventive here.

Of course, other multiples of compressors and compressor banks as well as condensers can be utilized within the scope of this invention.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A refrigerant cycle comprising:

a plurality of compressors, where at least two of said compressors receive a refrigerant from a suction manifold leading from a common evaporator, refrigerant from said compressors then passing into a plurality of condensers, said plurality of condensers associated with said plurality of said compressors, where said at least two compressors are connected to separate ones of said condensers, and wherein said plurality of condensers are associated with at least two distinct heat rejection zones.

2. The refrigerant cycle as set forth in claim 1, wherein at least one of said plurality of compressors is a compressor bank having its own plurality of compressors delivering refrigerant to a common condenser.

3. The refrigerant cycle as set forth in claim 1, wherein a separate expansion device is positioned to receive refrigerant downstream of said plurality of condensers.

4. The refrigerant cycle as set forth in claim 1, wherein said plurality of compressors includes at least three compressors.

5. The refrigerant cycle as set forth in claim 4, wherein at least one of said plurality of compressors is a compressor bank having its own plurality of compressors receiving refrigerant from a common suction manifold leading from said common evaporator.

6. The refrigerant cycle as set forth in claim 1, wherein at least one of said compressors has a flow control device on a discharge line leading to a corresponding one of said plurality of condensers.

7. The refrigerant cycle as set forth in claim 6, wherein said flow control device is of an adjustable type by one of modulation and pulsation control.

8. The refrigerant cycle as set forth in claim 1, wherein at least two of said heat rejection zones are maintained at substantially different temperatures.

9. The refrigerant cycle as set forth in claim 1, wherein at least one of said heat rejection zones is associated with an indoor environment, and at least one of said heat rejection zones is associated with an outdoor environment.

10. The refrigerant cycle as set forth in claim 1, wherein distinct fluid moving devices are associated with at least two of said plurality of condensers.

11. A method of operating a refrigerant cycle comprising the steps of:

1) providing a refrigerant cycle including a plurality of compressors where at least two of said compressors receive refrigerant from a common evaporator through a suction manifold, refrigerant passing from said compressors to a plurality of condensers, with each of said condensers receiving refrigerant from one of said plurality of compressors, and wherein said plurality of condensers are associated with at least two distinct heat rejection zones; and 2) operating said refrigerant cycle by independently controlling refrigerant flow to each of said condensers.

12. The method as set forth in claim 11, wherein at least one of said plurality of compressors includes a compressor bank including its own plurality of compressors, and said compressor bank being controlled to achieve desired conditions within an environment to be conditioned.

13. The method as set forth in claim 11, wherein a discharge flow control device downstream of at least one of said compressors is adjusted by one of modulation and pulsation control.

14. The method as set forth in claim 11, wherein an expansion device is positioned downstream of said condensers, and said expansion device being controlled to achieve a desired condition within an environment to be conditioned.

15. The method as set forth in claim 11, wherein at least two of said heat rejection zones are maintained at substantially different temperatures.

16. The method as set forth in claim 11, wherein at least one of said heat rejection zones is associated with an indoor environment, and at least one of said heat rejection zones is associated with an outdoor environment.

17. The method as set forth in claim 11, wherein distinct fluid moving devices are associated with at least two of said plurality of condensers.

* * * * *